US006059329A

United States Patent [19]

Spitzley

[11] Patent Number: 6,059,329

[45] Date of Patent: May 9, 2000

[54] DOOR HANDLE ASSEMBLY WITH SELF-ACTUATED MOUNTING

[75] Inventor: Larry W. Spitzley, Mulliken, Mich.

[73] Assignee: ADAC Plastics Inc.

[21] Appl. No.: 09/042,196

[22] Filed: Mar. 13, 1998

[51] Int. Cl.[7] ..... E05B 3/00

[52] U.S. Cl. ..... 292/336.3; 292/348; 292/DIG. 31; 292/DIG. 53; 16/112

[58] Field of Search ..... 292/336.3, 348, 292/353, 352, DIG. 30, DIG. 31, DIG. 53, DIG. 64; 70/451; 16/112; 29/434, 436, 450; 296/152, 146.1

[56] References Cited

U.S. PATENT DOCUMENTS

| | | | |
|---|---|---|---|
| 3,507,132 | 4/1970 | Schwenk | 70/224 |
| 4,038,718 | 8/1977 | Reilhac et al. | 16/110 R |
| 4,343,501 | 8/1982 | Meeks | 292/336.3 |
| 4,492,396 | 1/1985 | Luke et al. | 292/228 |
| 4,834,433 | 5/1989 | Keller | 292/336.3 |
| 4,892,342 | 1/1990 | Newman et al. | 292/347 |
| 4,898,415 | 2/1990 | Satoh | 292/347 |
| 5,183,302 | 2/1993 | Pelachyk et al. | 292/336.3 |
| 5,238,276 | 8/1993 | Burns | 292/347 |
| 5,248,178 | 9/1993 | Burns | 292/347 |
| 5,263,750 | 11/1993 | Smith et al. | 292/336.3 |
| 5,282,657 | 2/1994 | Clinch et al. | 292/336.3 |
| 5,284,373 | 2/1994 | Watson | 292/347 |
| 5,340,174 | 8/1994 | Bender et al. | 292/336.3 |
| 5,651,163 | 7/1997 | Tamaki | 16/112 |
| 5,706,554 | 1/1998 | Ruckert et al. | 16/112 |

*Primary Examiner*—Steven Meyers
*Assistant Examiner*—Clifford B. Vaterlaus
*Attorney, Agent, or Firm*—Young & Basile PC

[57] ABSTRACT

An automotive door handle assembly adapted to be mounted in an aperture defined in the outer skin of a motor vehicle door by a flange structure. The assembly includes an escutcheon plate sized to fit in the door skin aperture and having a peripheral flange sized to fit against an outer face of the outer door skin in surrounding relation to the door skin aperture. The door handle is pivotally mounted on a front face of the escutcheon plate for door unlatching movement, and a locking member is slidably mounted on a rear face of the escutcheon plate. The locking member is maintained in a preliminary mounting position by latching engagement of a latch on the locking member with a latch on the rear face of the escutcheon plate and pivotal movement of the handle has the effect of releasing the latching engagement of the locking member with the escutcheon plate to allow the locking member to move under spring biasing to a locking position in which pins on the locking member engage an inner face of the door skin flange structure to pull the escutcheon plate flange against an outer face of the door skin flange structure. Mounting of the door handle assembly in the door therefore consists simply in passing the assembly through the door aperture and actuating the door handle.

11 Claims, 4 Drawing Sheets

FIG-1
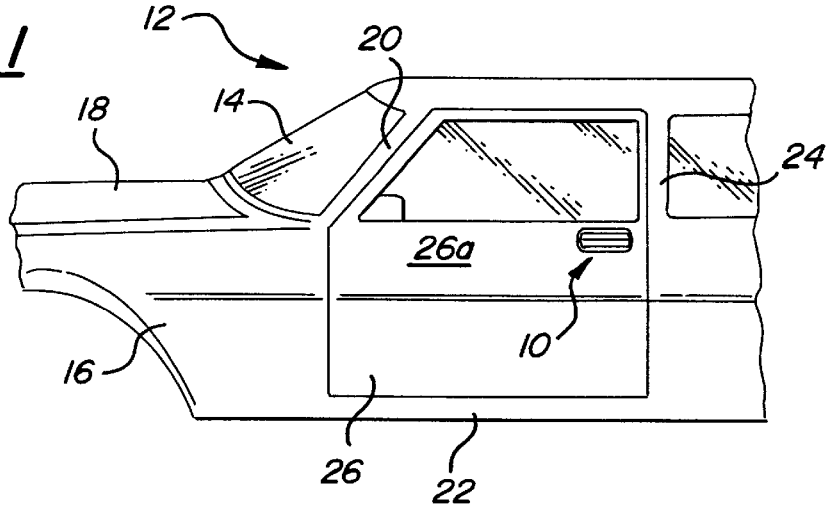
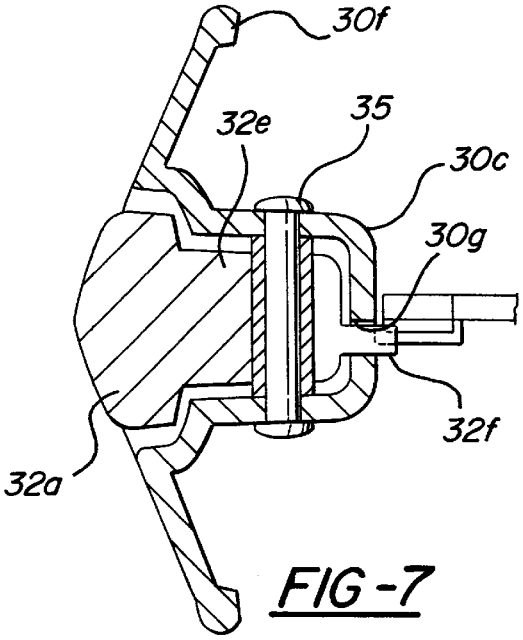
FIG-7
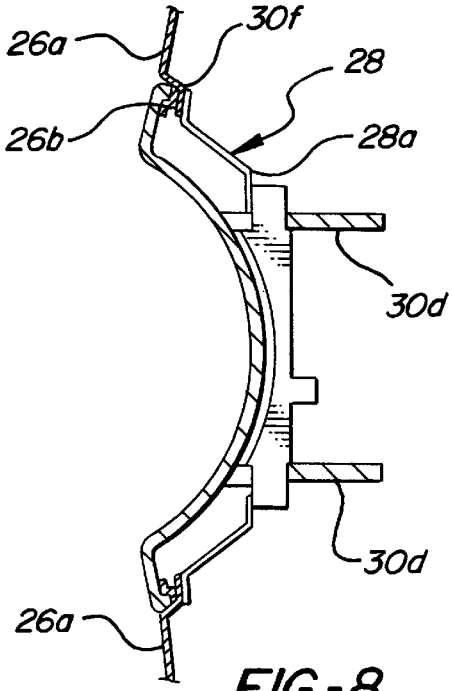
FIG-8
FIG-10
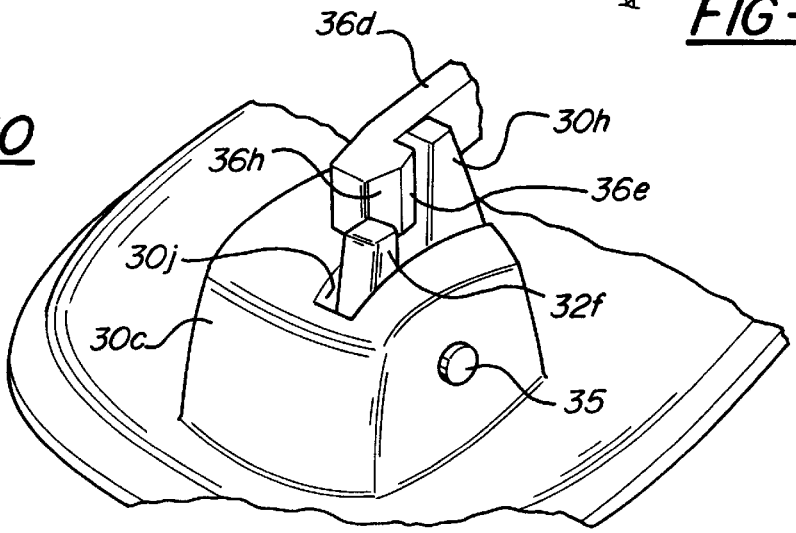

DOOR HANDLE ASSEMBLY WITH SELF-ACTUATED MOUNTING

BACKGROUND OF THE INVENTION

This invention relates to door handle assemblies and more particularly to door handle assemblies that are especially adapted for use on motor vehicles.

The cost of assembly in a motor vehicle is an ongoing concern. One of the assembly costs is the labor cost required to install the motor vehicle door handle assemblies in the vehicle doors.

SUMMARY OF THE INVENTION

This invention is directed to the provision of a door handle assembly that may be installed in a motor vehicle door with a minimum of labor cost.

The door handle assembly is adapted to be mounted in an aperture in the outer skin of a motor vehicle door. According to the invention, the handle assembly includes an escutcheon plate sized to fit in the door skin aperture and having a peripheral flange sized to fit against an outer face of an outer door skin in surrounding relation to the door skin aperture; a handle mounted on a front face on the escutcheon plate for door unlatching movement relative to the escutcheon plate; and mounting means operative, with the escutcheon plate positioned in the door skin aperture and the escutcheon plate flange positioned against the outer face of the door skin in surrounding relation to the door aperture, to fixably mount to the door handle assembly in the door skin aperture in response to unlatching movement of the door handle relative to the escutcheon plate. This arrangement allows the door handle assembly to be mounted in the door simply by placing the handle assembly in the door aperture and actuating the handle of the door handle assembly.

According to further feature of the invention, the mounting means comprises a locking member mounted on a rear face of the escutcheon plate and maintained in a spring loaded preliminary position, and release means operative in response to unlatching movement of the handle relative to the escutcheon plate to release the locking member for spring biased movement to a locking position in which the door handle assembly is fixably mounted in the door skin aperture. This arrangement provides a firm, positive spring biased locking movement in response to actuation of the door handle.

According to further feature of the invention, the release means comprises a release finger moveable in a releasing direction in response to an unlatching movement of the handle; the handle is mounted for pivotal unlatching movement relative to the escutcheon plate about a pivot axis defined by the escutcheon plate; and the release finger comprises an extension of the handle proximate the pivot axis. This specific arrangement provides a simple and positive release of the locking member in response to handle actuation.

According to further feature of the invention, the door skin aperture is defined by a flange structure surrounding the door skin aperture and the locking member is operative in its locking position to engage an inner face of the door skin flange structure and pull the escutcheon plate flange against an outer face of the door skin flange structure. This specific arrangement provides a firm positive mounting of the door handle assembly in the door.

According to further feature of the invention, the locking member includes a plurality of pins sized to pass through circumferentially spaced notches in the door skin flange structure to allow positioning of the escutcheon plate in the door skin aperture. This arrangement allows the door handle assembly to be positioned in the door skin aperture whereafter the locking member may be released to fixably mount the door handle assembly in the door.

In the disclosed embodiment of the invention the locking member includes a latch portion engaging a latch portion on the rear face of the escutcheon plate with the locking member in its preliminary position to maintain the locking member in a spring loaded condition and the release means comprises means operative in response to pivotal movement of the handle to disengage the latch portion of the locking member from the latch portion of the escutcheon plate to allow the locking member to undergo spring biased movement to its locking position.

The invention also defines an improved methodology for mounting an automotive door handle in an aperture in an outer skin of a motor vehicle door. According to the invention methodology, the escutcheon plate is positioned in the door skin aperture with the escutcheon plate flange positioned against the outer face of the door skin in surrounding relation to the door skin aperture and the handle is moved in an unlatching direction to fixably mount the door handle assembly in the door skin aperture. With this arrangement the door handle assembly is simply placed in the door skin aperture and the handle actuated to mount the door handle assembly in the door.

BRIEF DESCRIPTION OF THE DRAWINGS

FIG. 1 is a fragmentary view of a motor vehicle embodying a door handle assembly according to the invention;

FIGS. 5, 6, 7 and 8 are cross sectional views taken respectively on lines 5—5, 6—6, 7—7 and 8—8 of FIG. 4;

FIGS. 9 and 10 are detail views showing an unlatching mechanism employed in the invention door handle assembly.

DETAILED DESCRIPTION OF PREFERRED EMBODIMENT

Figure 2:
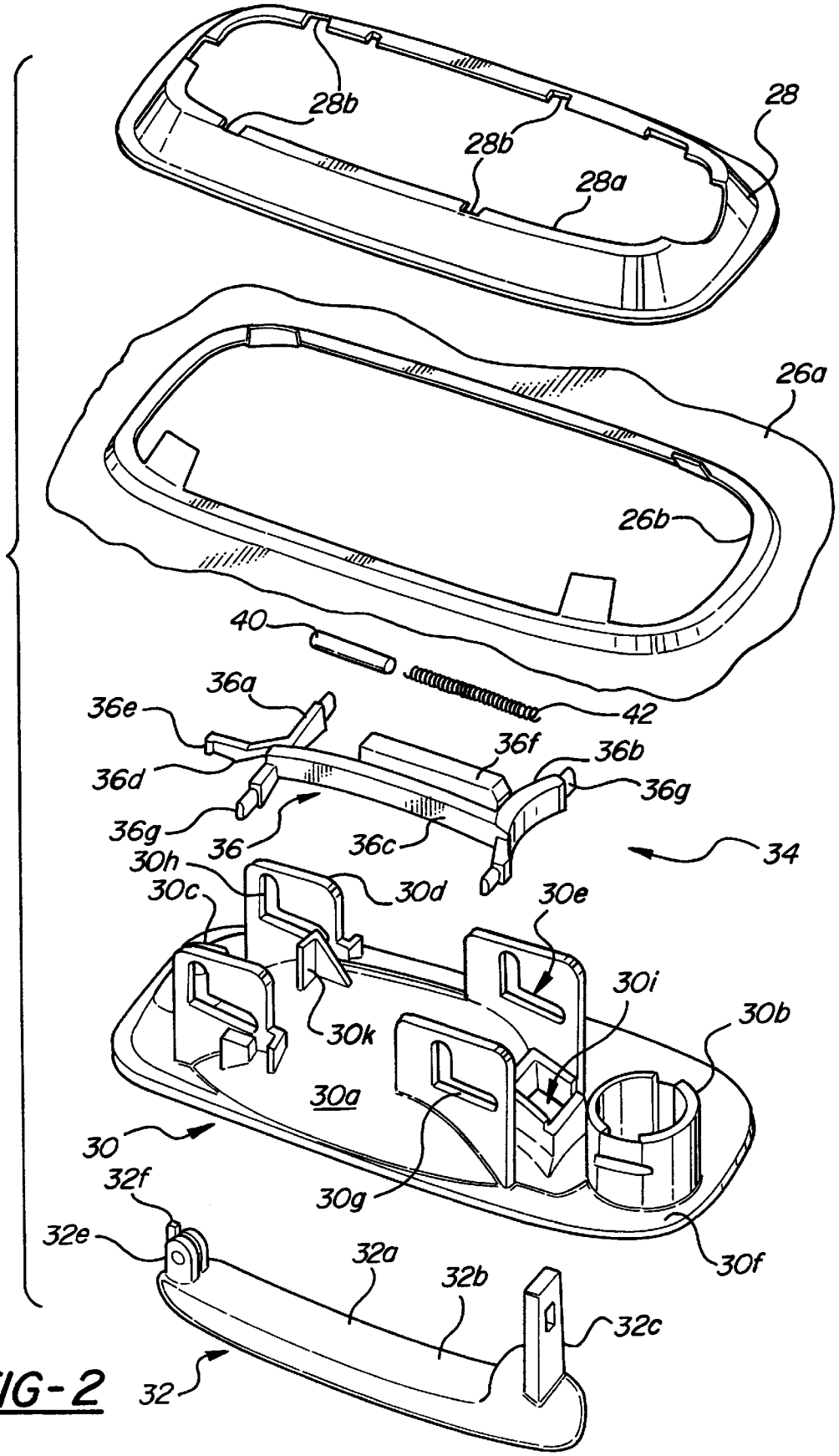
FIG. 2 is a perspective exploded view of the invention door handle assembly.
Figure 3:
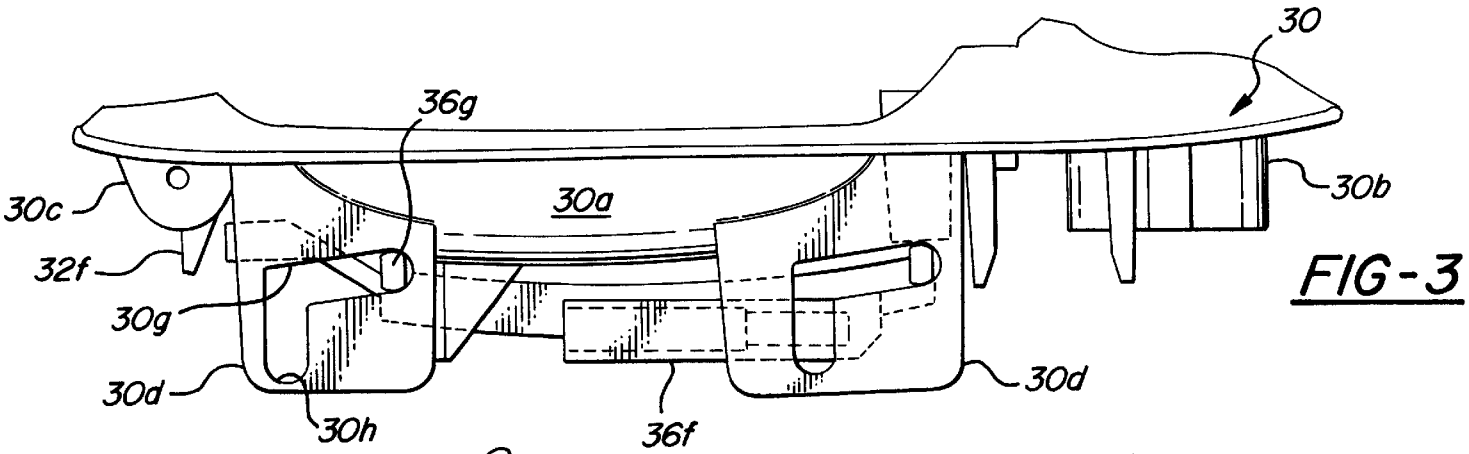
FIG. 3 is a top view of the door handle assembly.
Figure 4:
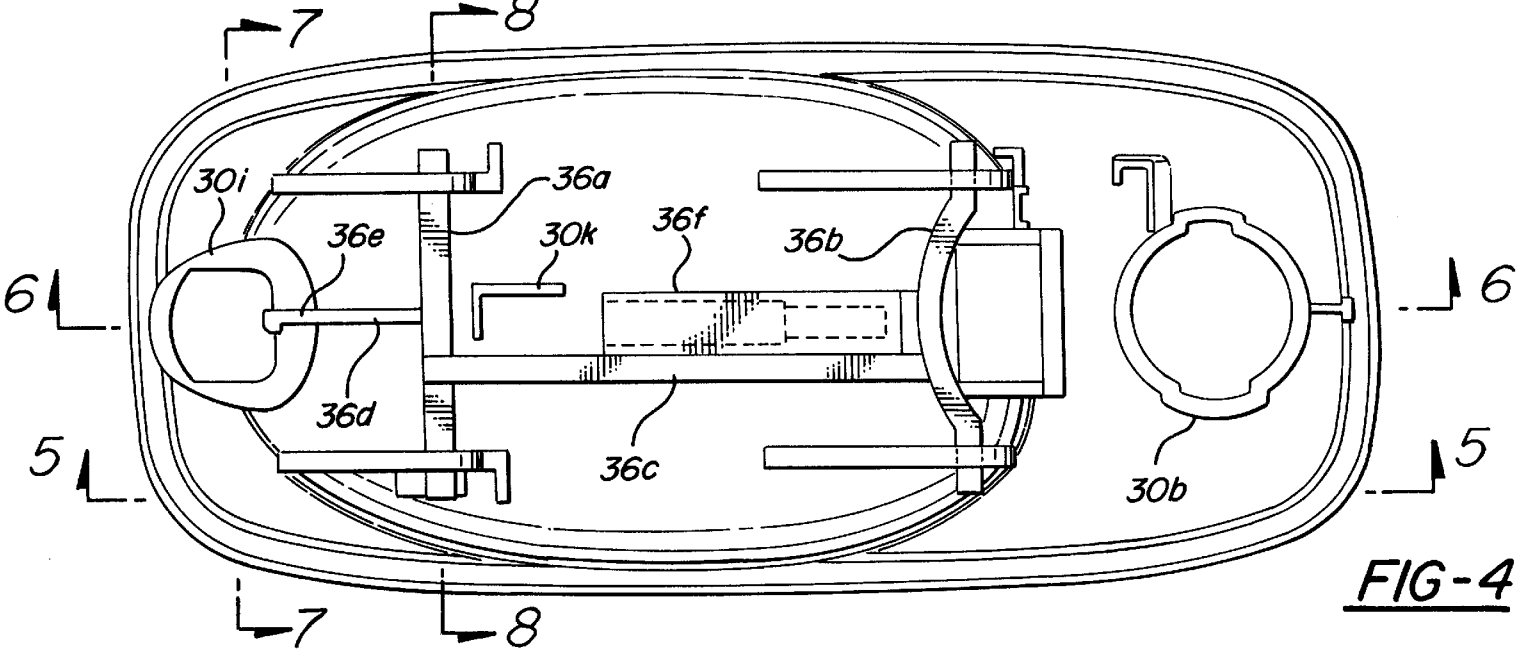
FIG. 4 is a rear side elevational view of the door handle assembly.
Figure 9:
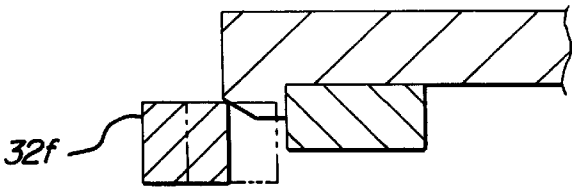

The invention door handle assembly 10 is seen in FIG. 1 in association with a fragmentarily shown motor vehicle 12 including a windshield 14, a front quarter panel 16, a hood 18, an A pillar 20, a sill 22, a B pillar 24, and a door 26 positioned in the door opening defined by A pillar 20, front quarter panel 16, sill 22, and B pillar 24 and including an outer skin 26*a*.

Door outer skin 26*a* includes a depressed annular flange 26*b*, and a reinforcing annular flange 28 is welded to flange 26*b* and includes an inner flange portion 28*a* defining a door skin aperture or opening 28*b* sized to receive the door handle assembly 10.

Door handle assembly 10, broadly considered, includes an escutcheon plate or bezel 30, a handle 32, and a locking assembly 34.

Escutcheon plate 30 is preferably formed as a molded plastic part and includes a main body bowl portion 30*a* a key cylinder lock housing 30*b* proximate one end of the escutcheon plate, a handle pivot housing 30*c* proximate the other end of the escutcheon plate, a plurality of lugs 30*d* extending rearwardly from bowl portion 30*a* and each defining an L-shaped slot 30*e*, and a circumferential flange portion 30*f* extending around the entire periphery of the escutcheon plate in encircling relation to bowl portion 30*a*, key cylinder lock housing 30*b*, and handle pivot portion 30*c*.

Figure 6:
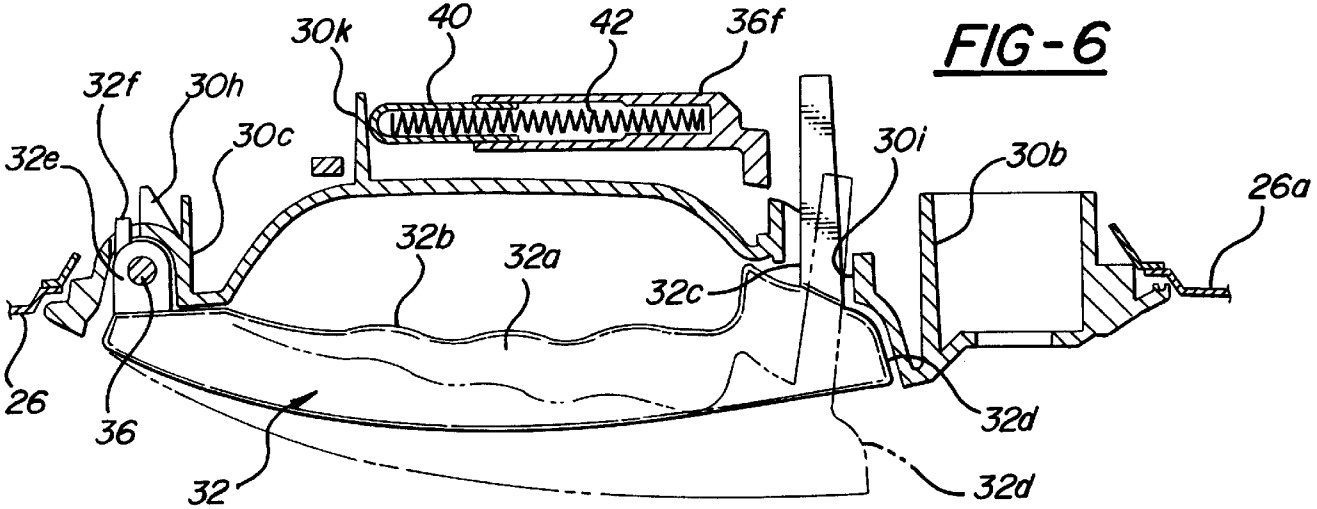

Handle 32 is also preferably formed as a molded plastic part and includes an elongated main body portion 32*a* having indulations 32*b* to facilitate grasping of the handle, an actuator portion 32*c* extending rearwardly from one end 32*d* of the handle through an aperture 30*i* in the escutcheon plate for connection in known manner to a suitable door unlatching mechanism (not shown), and a pivot portion 32*e* proximate the other end of the handle received in the pivot housing 30*c* of the escutcheon plate and pivotally mounted to the escutcheon plate by a pin 35 to allow the handle to be moved in an unlatching direction relative to the escutcheon plate from the solid line position seen in FIG. 6 to the dash line position seen in FIG. 6. Handle 32 further includes a latch finger portion 32*f* extending rearwardly from pivot portion 32*e* and passing through a slot 30*j* in the escutcheon plate pivot housing portion 30*c*.

Locking assembly 34 includes a locking member 36, a piston or plunger 40, and a spring 42.

Locking member 36 has a skeletal configuration and includes a pair of transversely extending cross arms 36*a* and 36*b*; a longitudinally extending spine or gang bar 36*c*; a latch bar 36*d* defining a latch 36*e* at its free end; and a cylinder housing 36*f* extending parallel to and formed integrally with gang bar 36*c*. A pin 36*g* of generally oval cross sectional configuration is formed at each free end of each cross bar 36*a* and 36*b*. Each pin 36*g* is sized and configured to be slidably but firmly received in a laterally and forwardly angled portion 30*g* of a respective slot 30*e* in a respective escutcheon plate lug 30*d*. Specifically, each oval pin 36*g* has a major dimension generally corresponding to the width of slot portions 30*g*. Each slot 30*e* further includes a rearwardly extending portion 30*h* to facilitate insertion of the pins 36*g* in the respective slots 30*e*. Plunger 40 is sized to fit slidably in the bore of locking member cylinder housing 36*f* and spring 42 is positioned in the bore of the cylinder housing and urges the piston outwardly with respect to the cylinder housing.

In the preliminary, pre-mounting condition of the locking assembly, pins 36*g* are slideably received in the respective forwardly angled slot portions 30*g* and latch portion 36*e* of the locking member is maintained in latching engagement with a finger latch portion 30*l*, extending rearwardly from escutcheon plate pivot housing 30*c* proximate slot 30*g*, by the engagement of plunger 40 with a stop lug 30*k* extending rearwardly from escutcheon plate bowl portion 30*a* to compress spring 42.

To mount the door handle assembly in the vehicle door, the door assembly, with the locking arm maintained in the preliminary spring loaded position by the compression of spring 42, is passed through door aperture 28*a* from a location outside of the door to position the flange 30*f* of the escutcheon plate against the depressed flange 26*b* of the outer skin 26*a*. A gimp or seal 44 is normally interposed between escutcheon plate flange 30*f* and door flange 26*b* for fit and sealing purposes.

Figure 5:
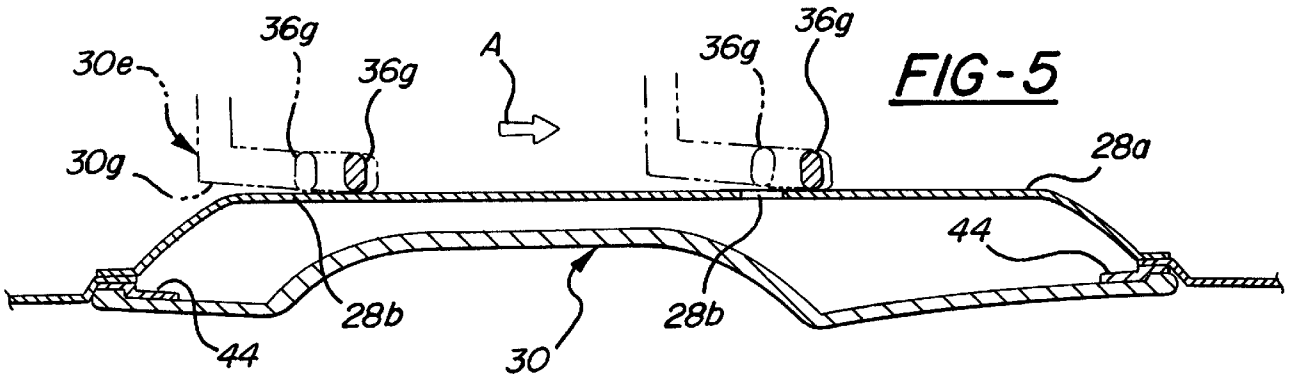

The movement of the door handle assembly to a position within the door skin aperture is made possible by movement of the locking member pins 36*g* rearwardly through notches 28*b* in the inner flange portion 28*a* of reinforcing flange 28 to position the pins 36*g* in the dotted line position seen in FIG. 5, whereafter handle 32 is moved pivotally from the solid line door latched position of FIG. 6 to the dotted line door unlatched position of FIG. 6. As the handle moves to its unlatched position, latch finger 32*f* on the handle engages a bevelled surface 36*h* on the latch portion 36*e* of the latch bar 36*d* to urge the latch portion 36*e* rearwardly to a position where it clears the rear face of escutcheon plate latch portion 30*l* at which time spring 42 extends to move the locking member 36 in the direction of the arrow A in FIG. 5 to drive the pins 36*g* laterally and forwardly in laterally and forwardly angled slot portions 30*g* from their dotted line loading positions to their solid line installed positions as seen in FIG. 5.

This movement moves the pins into engagement with the rear or inner face of inner flange portion 28*a* of reinforcing flange 28 and pulls the escutcheon plate flange 30*f* inwardly against the outer face of door opening flange 26*b* to fixably and positively lock the door handle assembly in the door skin aperture. The parameters of the assembly are such that reinforcing flange 28 is resiliently flexed in response to the movement of the pins 36*g* from their dotted line to their solid line positions in FIG. 5 whereby to exert a resilient pulling force on the escutcheon plate to firmly press the escutcheon plate flange 30*f* into engagement with the door opening flange.

Following installation of the door handle assembly in the door skin opening, handle unlatching portion 32*c* is suitably connected to an unlatching mechanism so that subsequent pivotal movement of the door handle to its unlatched position has the effect of unlatching the door. It will be understood that this subsequent pivotal unlatching movement of the handle has no effect on the locking mechanism since the door handle finger 32*f* now simply moves freely in the slot 30*g* with no effect on latch portion 36*e* since latch portion 36*e* has been moved to an out of the way position in response to the locking installation movement of the door handle.

It will be seen that the invention provides a motor vehicle door handle assembly that allows for the ready, rapid, and inexpensive installation of the door handle assembly in a vehicle door. Specifically, the invention apparatus and methodology allows the door handle assembly to be installed in the door aperture without having to reach behind the door handle assembly to perform any fastening operations and without requiring the use of any tools.

Whereas a preferred embodiment of the invention has been illustrated and described in detail, it will be apparent that various changes may be made in the disclosed embodiment without departing the scope or spirit of the invention.

I claim:

1. An automotive door handle assembly adapted to be mounted in an aperture in the outer skin of a motor vehicle door, the handle assembly comprising:

an escutcheon plate adapted to fit in the door skin aperture and having a peripheral flange adapted to fit against an outer face of the outer door skin in surrounding relation to the door skin aperture;

a handle mounted on a front face of the escutcheon plate for door unlatching movement relative to the escutcheon plate; and mounting means operative, with the escutcheon plate positioned in the door skin aperture and the escutcheon plate flange positioned proximate the outer face of the door skin in surrounding relation to the door skin aperture, to fixedly mount the door handle assembly in the door skin aperture in response to unlatching movement of the door handle relative to the escutcheon plate, the mounting means comprising:

a locking member mounted on a rear face of the escutcheon plate for movement between a preliminary position allowing passage of the door handle assembly through the door skin aperture and a locking position in which the door handle assembly is fixedly mounted in the door skin aperture;

spring means for urging the locking member toward its locking position;

locking member latch means operative to releasably maintain the locking member in its preliminary position against the urging of the spring means; and release means operative in response to door unlatching movement of the handle relative to the escutcheon plate to release the locking member latch means and allow movement of the locking member under the urging of the spring means to its locking position to fixedly mount the door handle assembly in the door skin aperture.

2. A door handle assembly according to claim 1 wherein the release means comprises a release finger movable in a releasing direction in response to unlatching movement of the handle.

3. A door handle assembly according to claim 2 wherein:

the handle is mounted for pivotal unlatching movement relative to the escutcheon plate about a pivot axis defined by the escutcheon plate; and the release finger comprises an extension of the handle proximate the pivot axis.

4. A door handle assembly according to claim 2 wherein the locking member is operative in its locking position to engage an inner face of the door skin and pull the escutcheon plate flange structure against an outer face of the door skin.

5. An automotive door handle assembly adapted to be mounted in an aperture in the outer skin of a motor vehicle door, the handle assembly comprising:

an escutcheon plate sized to fit in the door skin aperture and having a peripheral flange sized to fit against an outer face of the outer door skin in surrounding relation to the door skin aperture;

a handle mounted on a front face of the escutcheon plate for door unlatching movement relative to the escutcheon plate; and mounting means operative, with the escutcheon plate positioned in the door skin aperture and the escutcheon plate flange positioned proximate the outer face of the door skin in surrounding relation to the door skin aperture, to fixedly mount the door handle assembly in the door skin aperture in response to unlatching movement of the door handle relative to the escutcheon plate;

the mounting means comprising a locking member mounted on a rear face of the escutcheon plate and maintained in a spring loaded preliminary position and release means operative in response to door unlatching movement of the handle relative to the escutcheon plate to release the locking member for spring biased movement to a locking position in which the door handle assembly is fixedly mounted in the door skin aperature;

the locking member being operative in its locking position to engage an inner face of the door skin and pull the escutcheon plate flange structure against an outer face of the door skin;

the locking member including a plurality of pins sized to pass through circumferentially spaced notches in the door skin in surrounding relation to the aperture to allow positioning of the escutcheon plate in the door skin aperture.

6. A door handle assembly according to claim 5 wherein:

the escutcheon plate defines a plurality of slots at the rear face of the escutcheon plate; and each pin is slidably received in a respective slot.

7. A door handle assembly according to claim 6 wherein each slot is defined in a lug extending rearwardly from the rear face of the escutcheon plate.

8. An automotive door handle assembly adapted to be mounted in an aperture in an outer skin of a motor vehicle door defined by a door skin flange, the handle assembly including:

an escutcheon plate sized to fit in the door skin aperture and including a circumferential flange adapted to seat against an outer face of the outer skin in surrounding relation the door skin aperture;

a handle pivotally mounted on a front face of the escutcheon plate;

a locking member mounted on a rear face of the escutcheon plate for movement between a spring loaded preliminary position, to facilitate passage of the escutcheon plate through the door skin aperture, and a locking position in which the locking member engages the door skin flange to mount the handle assembly in the door skin aperture;

spring means for urging the locking member toward its locking position;

locking member latch means operative to releasably maintain the locking member in its preliminary position against the urging of the spring means; and release means operative in response to pivotal movement of the door handle on the escutcheon plate to release the locking member latch means and allow movement of the locking member under the urging of the spring means to its locking position to fixedly mount the door handle assembly in the door skin aperture.

9. A door handle assembly according to claim 8 wherein;

the locking member latch means includes a locking member latch portion engaging a latch portion on the rear face of the escutcheon plate with the locking member in its preliminary position to maintain the locking member in a spring loaded condition; and the release means comprises means operative in response to pivotal movement of the handle to release the latch portion of the locking member from the latch portion of the escutcheon plate to allow the locking member to undergo spring biased movement to the locking position.

10. A door handle assembly according to claim 9 wherein the release means comprises a finger defined by the handle proximate the pivot axis of the door handle and operative in response to pivotal movement of the handle to release the latch portion of the locking member from the latch portion of the escutcheon plate.

11. A method of mounting an automotive door handle assembly in an aperture in an outer skin of a motor vehicle door comprising:

providing a door handle assembly including an escutcheon plate sized to fit in the door skin aperture and a handle mounted on a front face of the escutcheon plate for unlatching movement relative to the escutcheon plate;

providing a locking member on a rear face of the escutcheon plate movable between a preliminary position allowing passage of the door handle assembly through the door skin aperture from the front of the door and a locking position in which the locking member acts to fixedly secure the door handle assembly in the door skin aperture;

providing means operative in response to unlatching movement of the door handle relative to the escutcheon plate to move the locking member from its preliminary position to its locking position;

positioning the escutcheon plate in the door skin aperture with the locking member in its preliminary position; and moving the handle in an unlatching direction to move the locking member to its locking position to fixedly secure the door handle assembly in the door skin aperture;

the means operative to move the locking member to its locking position comprising a latch on the locking member coacting with a latch on the rear face of the escutcheon plate and spring means for urging the locking member towards its locking position maintaining the locking member latch in latching engagement with the escutcheon plate latch and the step of moving the handle in an unlatching direction acting to disengage the locking member latch from the escutcheon plate latch to allow the locking member to move to its locking position under the bias of the spring means.

* * * * *